US005199698A

United States Patent [19]

Seymour et al.

[11] Patent Number: 5,199,698

[45] Date of Patent: Apr. 6, 1993

[54] DOCUMENT FEEDER EMPLOYING A VARIABLE LOAD APPLICATOR AND AN ENDLESS BELT

[75] Inventors: Kenneth S. Seymour, Conestogo; Dennis T. Sonnenburg, Waterloo; Joseph Guido, Elmira, all of Canada

[73] Assignee: NCR Corporation, Dayton, Ohio

[21] Appl. No.: 846,119

[22] Filed: Mar. 5, 1992

[51] Int. Cl.[5] ..... B65H 3/04

[52] U.S. Cl. ..... 271/34; 271/149; 271/160; 271/256

[58] Field of Search ..... 271/34, 147, 149, 152-155, 271/160, 167, 256

[56] References Cited

U.S. PATENT DOCUMENTS

| | | | |
|---|---|---|---|
| 2,614,837 | 10/1952 | Cuthbert, Jr. | 271/149 X |
| 3,219,339 | 11/1965 | Gutierrez | 271/149 X |
| 3,874,732 | 7/1975 | Müller | 271/153 X |
| 3,988,017 | 10/1976 | Kyhl | 271/34 X |
| 4,919,412 | 4/1990 | Weigel et al. | 271/152 X |

FOREIGN PATENT DOCUMENTS

| | | | |
|---|---|---|---|
| 133130 | 7/1984 | Japan | 271/160 |
| 198966 | 8/1990 | Japan | 271/160 |

*Primary Examiner*—Robert P. Olszewski

*Assistant Examiner*—Boris Milef

*Attorney, Agent, or Firm*—Elmer Wargo

[57] ABSTRACT

An apparatus for feeding documents from a stack of documents, in single file, into a document track, with the apparatus employing an endless belt. The endless belt is mounted on a drive roller and an idler roller to provide a linear portion of the belt which is parallel to the first document to be fed from the stack. The apparatus also includes a retard mechanism which includes a first portion to engage the documents in the stack and also includes a second portion which is parallel to the linear portion of the endless belt and is biased towards the linear portion by a tension spring. The endless belt is made of a material which is designed to wear instead of "glazing" which provides for a positive feed. The endless belt and the retard member are designed to be replaced by an operator of the terminal in which the apparatus is located so as to avoid a service call by a maintenance person. The apparatus also includes a velocity sensor to detect the speed at which a pusher in the apparatus is moving the stack of documents towards the linear portion of the endless belt. If too fast, a motor driving the endless belt is disabled until a time has elapsed to permit stabilization of pressure on the first document to be picked from the stack.

10 Claims, 4 Drawing Sheets

FIG. 2
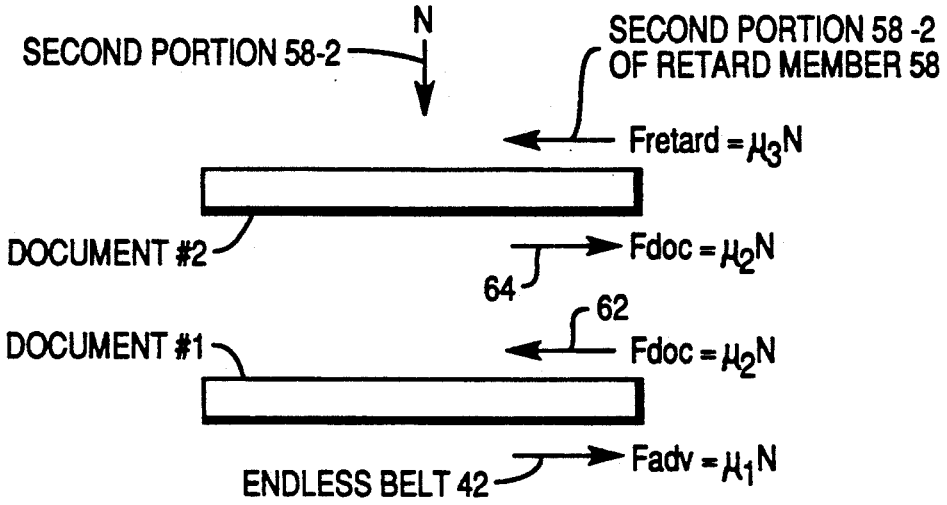
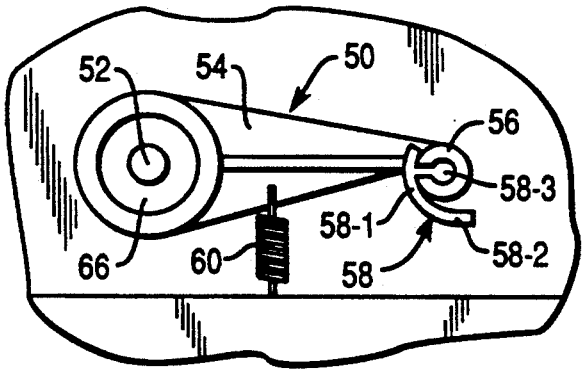
FIG. 4
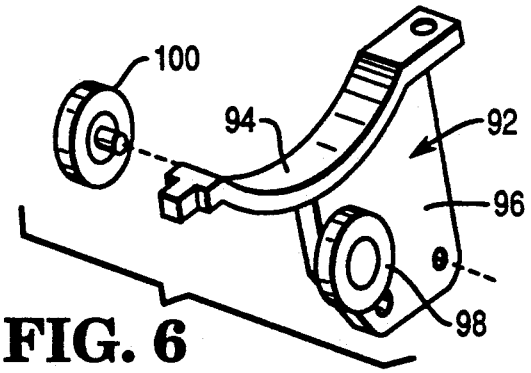
FIG. 6
FIG. 7
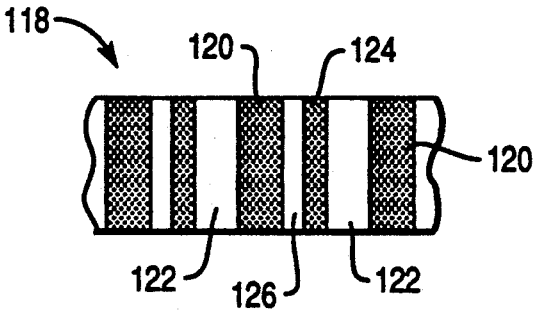

DOCUMENT FEEDER EMPLOYING A VARIABLE LOAD APPLICATOR AND AN ENDLESS BELT

CROSS REFERENCE TO RELATED APPLICATIONS

This application is related to copending application Ser. No. 07/846,091, entitled, "DOCUMENT FEED MECHANISM", by Kenneth S. Seymour, Dennis T. Sonnenburg and Joseph Guido, which application was filed on the same date as the present application and was assigned to the same assignee as the present application.

BACKGROUND OF THE INVENTION (1) Field of the Invention

This invention relates to an apparatus for feeding documents from a stack of documents, in single file, into a document track, with the apparatus employing a variable load applicator and an endless belt.

(2) Background Information

The purpose of a document feeder of the type mentioned is to separate or pick a document from a stack of documents in a hopper and feed it at a particular rate with an inter-document gap between documents to a downstream module like a reader, encoder, endorser, microfilmer, or a pocket module, for example.

Feeding a single document from a stack of documents generally requires advancing the first document in the stack, while inhibiting the remainder of the documents in the stack by a retard mechanism. The next document in the stack follows the trailing edge of the prior document which was just removed from the stack.

In some prior art designs, the retard mechanism used a roller which operated in a direction which was opposite to the direction of the associated feed roller. Such a design generally required a separate motor for the feed roller and a separate motor for the retard roller.

When feed and retard rollers are used, it is generally necessary to be very precise in the adjustment of the rollers relative to each other. As the rollers begin to wear, additional maintenance or adjustment is necessary. Replacing such feed and retard rollers, when excessively worn, generally requires that the maintenance be done by a service person. Very often, the feed and retard rollers become "glazed" or slippery in use, and consequently, they lose their effectiveness.

The hopper module which contains the stack of documents to be fed generally uses gravity and a spring to feed the documents in the stack to a point where the first document in the stack can be picked from the stack and fed into the document track. One of the problems in designing the hopper module is that it is difficult to maintain a constant pressure on the first document to be picked from the stack as the size of the stack changes from a full stack to one which is one quarter full, for example. When the pressure is not constant, misfeeds or nonfeeds result.

SUMMARY OF THE INVENTION

The objects of this invention are to provide a document feeding apparatus which:

1. Is simple and inexpensive to manufacture;
2. Minimizes the amount of adjustment required for the associated parts; and
3. Is designed to cause certain parts to wear so as to avoid the "glazing" mentioned, with these certain parts being easily replaceable.

4. Is designed to provide a variable load applicator on the stack of documents so that there is a relatively constant load at the "picking" mechanism of the apparatus.

In a preferred embodiment of this invention, there is provided a hopper module comprising:

a hopper;

a pusher;

biasing means for biasing said pusher from a loading station to a picking station in said hopper;

a document picker located at said picking station;

a velocity sensor for generating a velocity signal corresponding to the velocity of the pusher as the pusher is moved by said biasing means from said loading station towards a stack of documents in said hopper; and a controller for receiving the velocity signal and delaying the energization of said document picker for a predetermined time whenever the velocity signal exceeds a predetermined level.

In another aspect of this invention, there is provided an apparatus comprising:

a hopper module for storing a stack of documents to be fed;

said hopper module including:

a hopper having an alignment side and a stop;

a pusher;

biasing means for biasing said pusher from a loading station to a picking station located at said stop in said hopper;

a document picker located at said picking station;

a velocity sensor for generating a velocity signal corresponding to the velocity of the pusher as the pusher is moved by said biasing means from said loading station towards a stack of documents in said hopper; and a controller for receiving the velocity signal and delaying the energization of said document picker for a predetermined time whenever the velocity signal exceeds a predetermined level;

said document picker comprising:

a drive roller and an idler roller having an endless belt mounted thereon to provide a linear portion of the endless belt parallel to a first document to be picked from the stack, with said linear portion engaging the first document to be picked;

a retard mechanism positioned adjacent said alignment side and in opposed relationship with said linear portion of said endless belt;

said retard mechanism having a retard member including a first portion to engage the documents in said stack and also having a second portion substantially parallel to said linear portion to permit only one document to be moved towards a document track by said linear portion of said endless belt, said first and second portions forming a wiper; and a resilient member to bias said second portion towards said linear portion of said endless belt.

The above objects and advantages to be described will become more apparent upon a review of the following specification, claims, and drawing.

BRIEF DESCRIPTION OF THE DRAWING

FIG. 2 is a schematic diagram showing a relationship among various friction forces associated with the apparatus of this invention.

FIG. 4 is an enlarged, plan view of a retard mechanism shown in FIG. 1, with FIG. 4 being shown on the sheet containing FIG. 2.

FIG. 6 is an exploded view, in perspective, of a stabilizer member used with the pusher shown in FIG. 1, with FIG. 6 being shown on the sheet containing FIG. 2.

FIG. 7 is a schematic diagram of a timing strip used with this invention, with FIG. 7 being shown on the sheet containing FIG. 5.

DESCRIPTION OF THE PREFERRED EMBODIMENT

Figure 1:
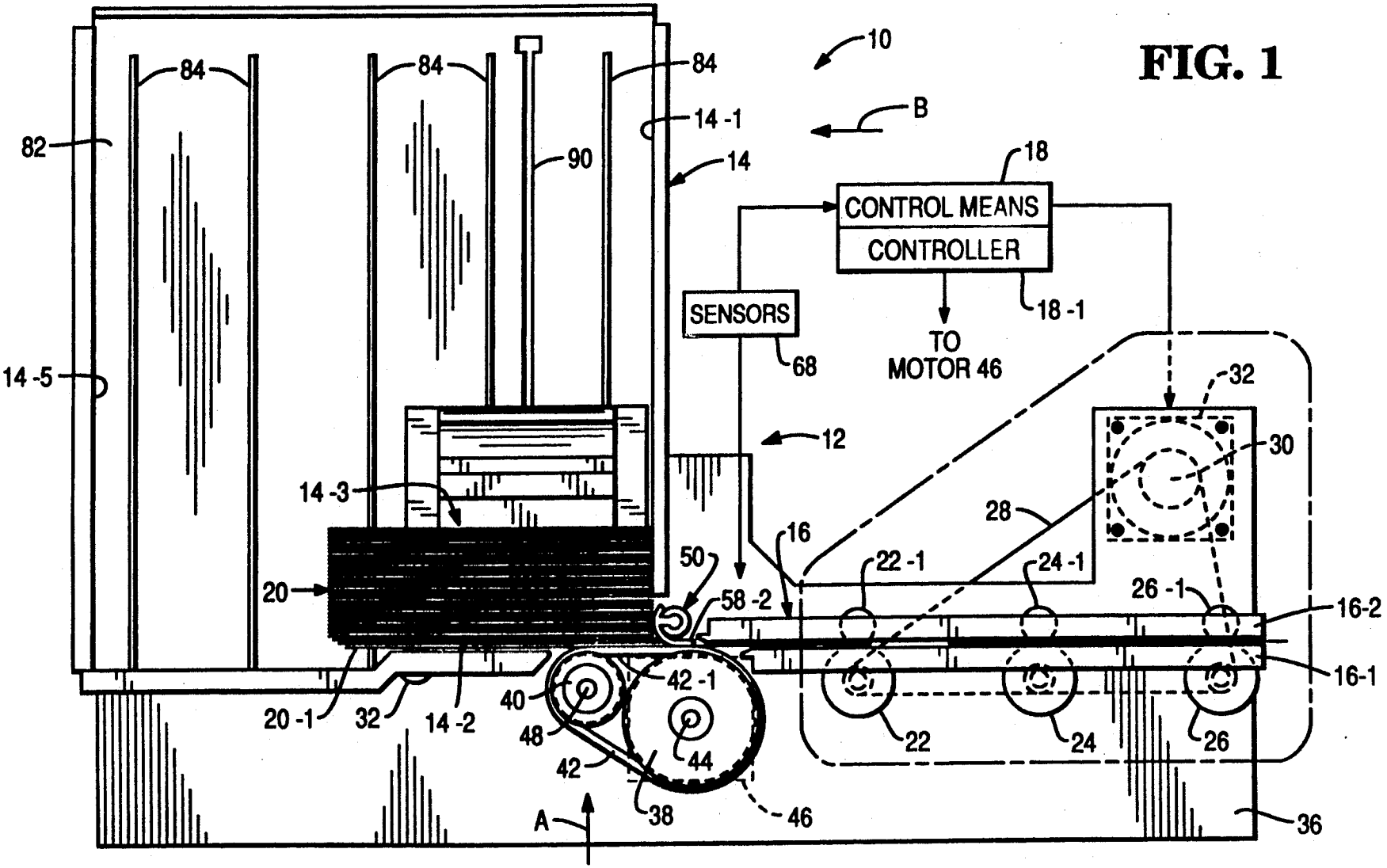
FIG. 1 is a plan view of the top of a terminal which includes the apparatus of this invention, showing a hopper including a stack of documents and a feeding means including an endless belt for feeding documents from a stack to a document track.

FIG. 1 is a plan view of a business machine or terminal 10 in which the apparatus 12 of this invention may be incorporated. The terminal 10 may be an encoder, for example, or other machine mentioned earlier herein. The apparatus 12 includes a hopper module 14, a document track 16, and a control means 18 for controlling the operation of the apparatus 12 in addition to controlling other functions associated with the terminal 10.

The function of the apparatus 12 is to pick a first document 20-1 from a stack 20 of documents which are located in the hopper module 14 and to feed the first document 20-1 into the document track 16 which has first and second upstanding side walls 16-1 and 16-2. This process is repeated for the next first document 20-1 in the stack 20 until the entire stack 20 of documents is fed into the document track 16. While the documents in the stack 20 are shown as being of the same size, this is merely a matter of convenience. In reality, a stack of documents can vary in length from about 4 inches to about 9 inches, for example. The top long edge of each document in the stack 20 of documents is shown in FIG. 1.

The apparatus 12 also includes feed rollers 22, 24, and 26 which are driven or rotated by an endless belt 28 which is coupled to a drive pulley 30 of a motor 32 which is controlled by the control 18. The feed rollers 22, 24, and 26 have associated pinch rollers 22-1, 24-1, and 26-1 to conventionally move a document, like 20-1, in a downstream direction, which is to the right as viewed in FIG. 1. Additional modules, like an endorsing station or an encoding station (not shown but associated with the terminal 10) may be located downstream of the feed roller 26, for example.

Figure 3:
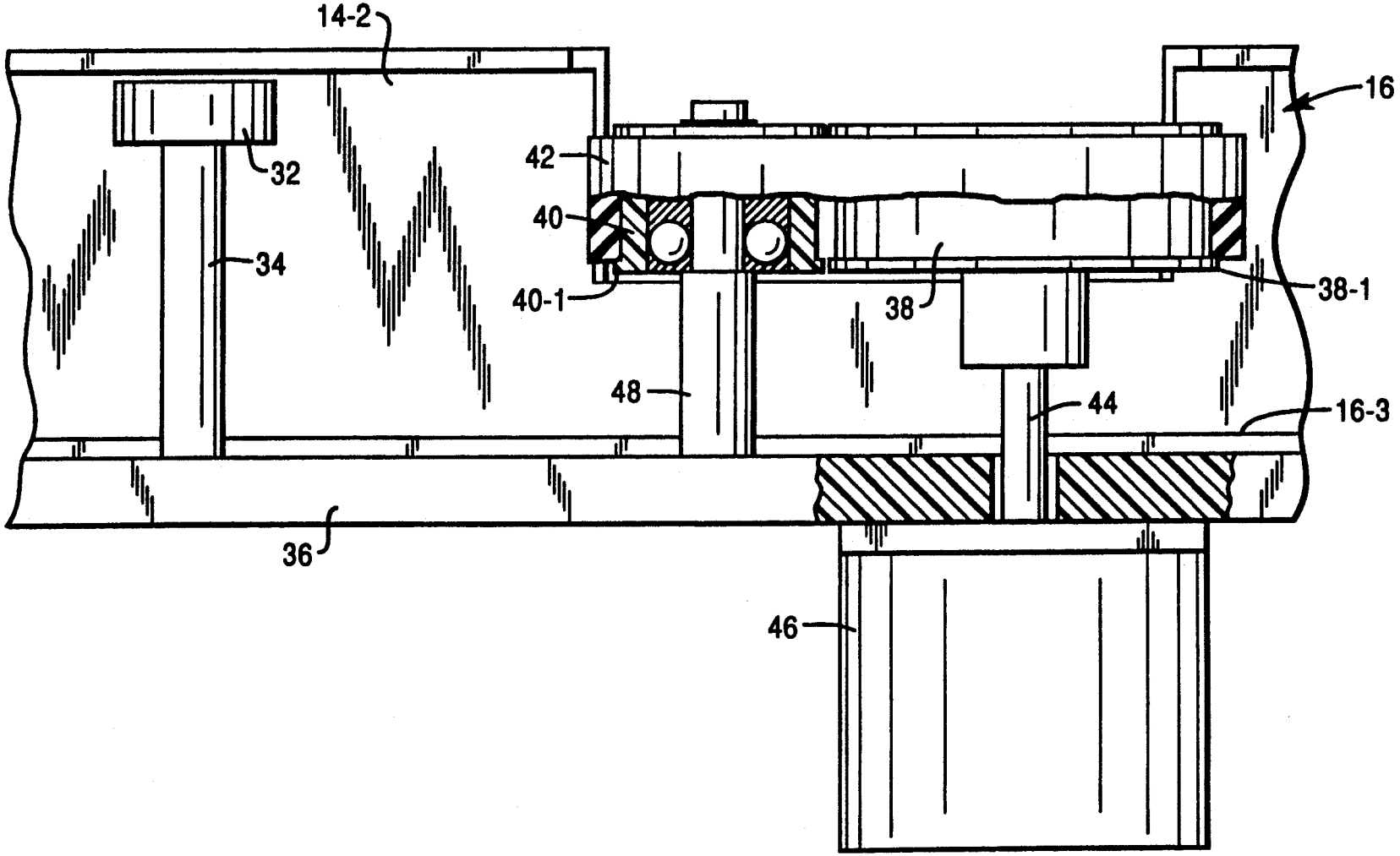
FIG. 3 is is an elevational view, looking from the direction of arrow A of FIG. 1, to show additional details of a means for mounting the endless belt shown in FIG. 1.

The hopper module 14 (FIG. 1) is designed to move a stack 20 of documents along an alignment side 14-1 towards a stop 14-2. A pusher 14-3 resiliently moves the stack 20 of documents towards the stop 14-2. Details of the hopper module 14 will be described hereinafter. The stop 14-2 has an idler roller 32 rotatably mounted thereby, with the idler roller 32 protruding from the stop 14-2 towards the stack 20 of documents to minimize any friction between the stack 20 and the stop 14-2. The idler roller 32 is rotatably mounted on a rod 34 (FIG. 3) which is upstanding from a frame 36 of the terminal 10.

The purpose of the apparatus 12 is to pick the documents in the stack 20, one at a time, and feed them at a specific rate, with a gap between successive documents being fed, to the document track 16, which in turn, feeds the documents to a module, like an endorser, for example, which is not shown.

The apparatus 12 includes a drive roller 38 (FIGS. 1 and 3) and an idler roller 40 which have an endless belt 42 mounted thereon. The drive roller 38 is coupled to the output shaft 44 of a motor 46 to be rotated thereby. The motor 46 is secured to the frame 36, and operates under the control of the control means 18 which includes a controller 18-1. The drive roller 38 and the idler roller 40 have flanges 38-1 and 40-1 which retain the endless belt on the associated rollers. The idler roller 40 is rotatably supported on a rod 48 which is upstanding from the frame 36.

The drive roller 38 and the idler roller 40 are positioned in the frame 36 (FIG. 1) so that the endless belt 42 has a straight or linear portion 42-1 which is parallel to the first document 20-1 to be picked from the stack 20. In the embodiment described, the endless belt 42 is positioned so that the centerline of its width is about 1.3 inches above the bottom 16-3 of the document track 16 as measured in a vertical direction, as viewed in FIG. 3. The width of the endless belt 42 is ¾ inch in the embodiment described. Naturally, the specific dimensions and locations of the endless belt 42 can be changed to suit particular applications.

The apparatus 12 also includes a retard mechanism 50 shown in FIGS. 1 and 4. The retard mechanism 50 functions as a wiper and cooperates with the feed means including the endless belt 42 to permit only one document at a time to be fed from the stack 20 of documents to the document track 16.

The retard mechanism 50 includes a support post 52 (FIG. 4) and an arm 54, having one end pivotally mounted on the support post 52, with the remaining or free end having a cylindrical portion 56 which is "C"-shaped in cross section. The retard mechanism 50 also has a retard member 58 which has a first portion 58-1 which engages the stack 20 of documents as shown in FIG. 1, and it also has a second portion 58-2 which is biased towards the linear portion 42-1 of the endless belt 42 by the tension spring 60 shown in FIG. 4. The retard member 58 also has a complementary member 58-3 which extends therefrom to enable the retard member 58 to be mounted on the arm 54 by having the complementary member 58-3 slide into the cylindrical portion 56. The support post 52 and the arm 54 are located below the hopper module 14, and the retard member 58 is positioned in the cylindrical portion 56 so that the second portion 58-2 of the retard member 58 is opposite to and is biased towards the linear portion 42-1 of the endless belt 42.

Before discussing the operation of the apparatus 12, it is useful to discuss the friction which exists between certain members of the apparatus 12. In this regard, FIG. 2 shows the various forces working on a document to be fed from the stack 20 of documents and moved to the document track 16. In effect, the documents are separated by differential friction. The second portion 58-2 of the retard member 58 applies a force N (via the spring 60) which is normal or perpendicular to the linear portion 42-1 of the endless belt 42, and the second portion 58-2 also has a coefficient of friction (COF)which is $u_3$.

The relationship of the COF of each of the members is as follows. The endless belt 42 (FIG. 2) has the highest COF which is equal to $u_1$; the second portion 58-2 of the retard member 58 has the next highest COF which is equal to $u_3$; and the COF of the documents in the stack 20 of documents is equal to $u_2$. Because the endless belt 42 has the highest COF, the force Fadv is the highest, and it is sufficient to drive the document #1 to the right as shown in FIG. 2, while the second portion 58-2 of the retard member 58 provides a force Fretard which is sufficient to stop the second document #2 from being fed to the right. There are inter-document forces Fdoc (shown by arrows 62 and 64).

These are some considerations which follow from the various forces due to friction shown in FIG. 2:

1. If the inter-document friction or force Fdoc is too high or the retard friction Fretard is too low, multiple feeding of the documents results; and 2. If the retard friction Fretard is too high or the advance friction Fadv is too low, the documents won't feed.

A major part of the design of the apparatus 12 is to ensure that there is no slippage between the endless belt 42 and the document #1 in FIG. 2; this document corresponds to the first document 20-1 in the stack 20 of documents. Relative slip between the document #1 and the endless belt 42 leads to "glazing" of the endless belt 42, and glazing of this belt leads to slippage and a loss of document throughput. Maintaining the required friction of the endless belt 42 is a key to ensuring a successful design.

A problem with the documents in the stack 20 of documents is that in addition to coming in a variety of sizes, the documents have varying paper properties. Some of these variations relate to type of paper, thickness, texture, humidity, and surface contaminants, like inks and waxes. Previously, replacement of parts was not necessitated, generally, by wear but by a loss of friction. It is a feature of the present invention that in order to maintain a high friction surface, a controlled amount of wear is desirable in the endless belt 42.

Several endless belts, like 42, were tried for the endless belt 42. The material which was found to work the best was a rubber type belt which has some proprietary elements in it. The particular endless belt 42 used is a "POSIFEED 3570" (trademark of Siegling Co.) belt, for example, which is manufactured by and currently available from the Siegling Co. of Charlotte, N.C. This particular belt wears out without "glazing." Naturally, other belts possessing these characteristics may be used. Another feature of the apparatus 12 is that when the endless belt 42 wears out, it is easy for an operator to replace the endless belt 42 with a new one. A service call by a maintenance person is not necessary to effect the change or replacement.

The retard member 58, in contrast, is made of a material, like urethane, which yields low wear. The cantilever design of the retard member 58 gives some flexibility to the relatively stiff material from which it is made. The flexibility of the second portion 58-2 enables this portion to conform to the linear portion 42-1 of the endless belt 42 without having to maintain tight tolerances between these elements. The arm 54 has a bearing 66 (FIG. 4) in its first end to enable the arm to freely rotate on the support post 52. The spring 60 keeps a sufficient normal force N (FIG. 2) on the endless belt 42. Variations due to wear on the retard member 58 and the endless belt 42 are thereby compensated for by the action of spring 60.

The design of the retard mechanism 50 also permits a sufficient "footprint" or area on the rear of the document to perform the restraining function. The retard member 58 can also be replaced, easily, by an operator instead of a service person by simply pulling up on the retard member 58, as viewed in FIG. 4, to remove it, and pushing down on a new one to push it in place. The retard member 58 is also designed to provide a curved "lead-in" from the first portion 58-1 to the second portion 58-2 for leading the documents into the document track 16.

The operation of the terminal 10 is as follows. When it is desired to feed a document or documents from the stack 20 of documents, the controller 18-1 (FIG. 1) issues the appropriate signals to the motor 46 to start the picking of the first document 20-1 and to start the drive motor 30 to receive the documents which are fed into the document track 16.

The apparatus 12 includes the necessary sensors 68 (shown schematically) which are positioned along the document track 16 to give an indication of the leading and trailing edges of the documents as is conventionally done. A first sensor 68 is located just upstream from the feed roller 22 to monitor the inter-space distance between the trailing edge of one document (the one just picked) and the leading edge of the next successive document. Another sensor 68 is located just downstream from feed roller 26 to monitor the inter-space distance between the documents leaving the apparatus 12, assuming the documents are moving downstream away from the apparatus 12 at a known constant speed.

When the motor 46 is stepped or rotated, the first document 20-1 is picked from the stack 20 and moved to the right as viewed in FIG. 1. The retard member 58 then functions to permit only the first document 20-1 to be moved to the document track 16, as previously described. The inter-space distance is achieved by picking the document much more slowly than the speed of the document in the document track 16, thus allowing the trailing edge of the document just picked to move away from the leading edge of the next successive document. When the leading edge of the document just picked is detected at the sensor 68 near the feed roller 26, both motors 46 and 30 are stopped, if necessary, to provide the appropriate inter-space distance between the trailing edge of one document (the one downstream from the apparatus 12) and the next successive document (the one just picked). When the appropriate inter-space distance is reached, both motors 46 and 30 are again energized or stepped to feed the next document.

The speed of motor 30 is determined by the required speed of the documents leaving the apparatus 12. It is desirable to pick documents as slowly as possible while still maintaining the required documents per minute feed rate. Accordingly, after each document 20-1 is picked, if the inter-space distance is too large, the speed of the document picking motor 46 is increased by approximately 1%. If the inter-space distance is too small, the speed of the document picking motor 46 is decreased by approximately 1%. The picking speed is thus varied by the controller 18-1 between the limits of 46% and 60% of the speed of a document moving in the document track 16 and will tend to seek an optimum speed. This process is repeated until all the documents in the stack 20 of documents has been fed.

Figure 5:
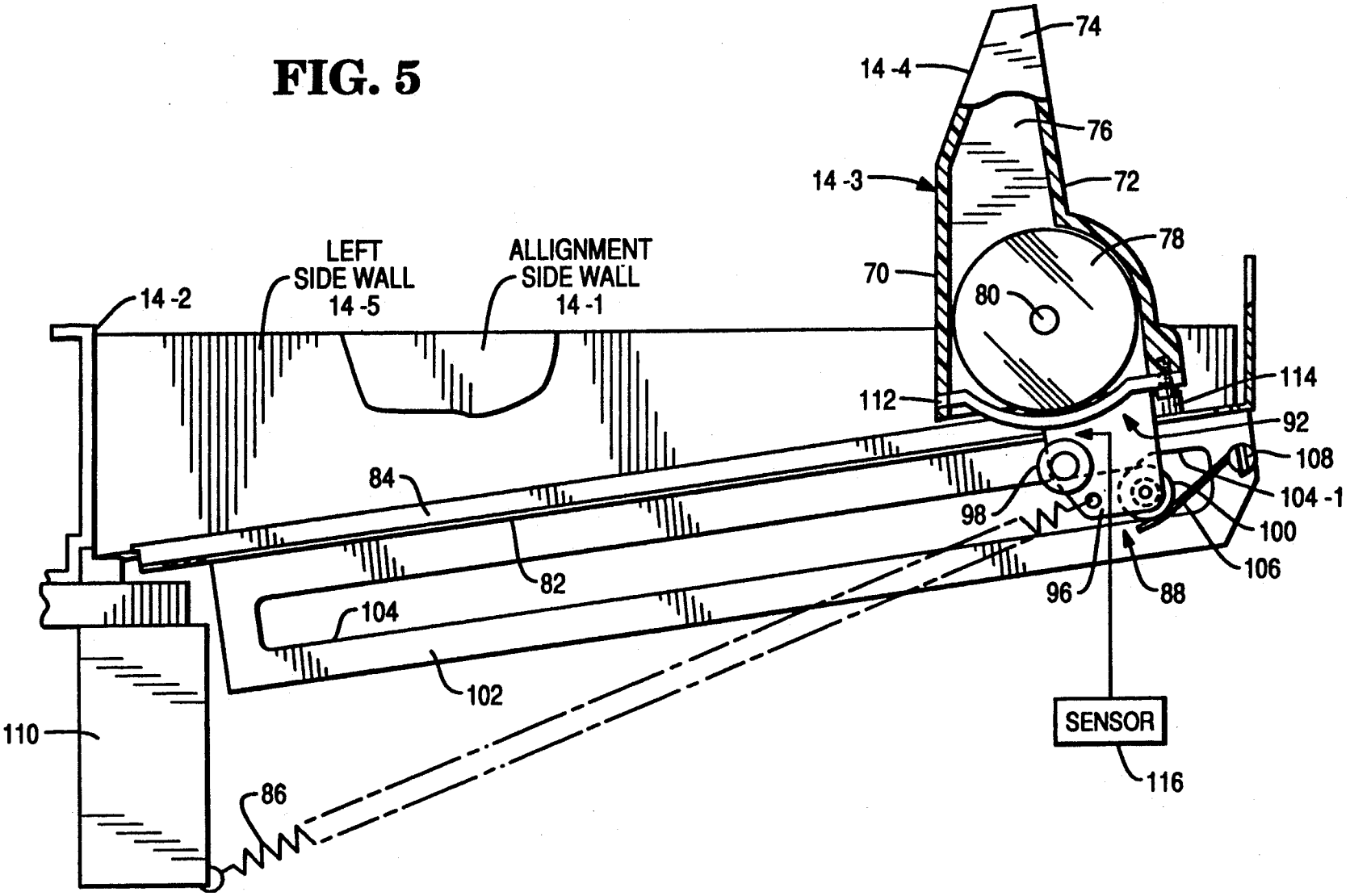
FIG. 5 is a side elevational view, taken from the direction of arrow B of FIG. 1.

Additional details of the hopper module 14 (FIG. 1) alluded to earlier herein, are shown in FIGS. 5 and 6. The pusher 14-3 includes a housing 14-4 having a front planar face or panel 70, a rear panel 72, and side panels 74 and 76 (FIG. 5). The rear panel 72 is shaped to conform to a roller 78 which has a large mass to move the stack 20 of documents towards a picking station which includes the endless belt 42 and the retard mechanism 50 described earlier herein. The roller 78 has a support shaft 80 extending slightly from each side, and the side panels 74 and 76 have mating recesses therein to receive the support shaft 80. The housing 14-4 of the pusher 14-3 is made of plastic, and the side panels 74 and 76 can be pushed apart, slightly, to receive the ends of the shaft 80 to rotatably mount the roller 78 between the side panels 74 and 76.

The hopper module 14 also has a left side wall 14-5 (FIG. 1) and a floor 82 with spaced, parallel rails 84 upstanding therefrom to support the stack 20 of documents and to enable the roller 78 to roll thereon with a minimum of friction. The rails 84 are spaced across the entire width of the hopper module 14; however, the pusher 14-3, including the roller 78, extends from the alignment side 14-1 to the idler roller 32, as shown best in FIG. 1. This is the area of the stack 20 of documents which is pushed against the stop 14-2, the idler roller 32, and the linear portion 42-1 of the endless belt 42. In the embodiment described, the roller 78 has a diameter of 1.75 inches, a length of about 4 inches, and a weight of about 3.3 pounds. The angle of the floor 82 of the hopper module 14 relative to a horizontal plane, as viewed in FIG. 5, is about 8 degrees. Under these circumstances, the roller 78 exerts a force of about 0.46 pounds against the stack 20 of documents. Naturally, for different applications, the parameters of the roller 78 and related elements can be changed.

The roller 78 is part of a biasing means which resiliently biases the pusher 14-3 from a loading station, shown approximately in FIG. 5, to a picking station including the linear portion 42-1 of the endless belt 42. The biasing means also includes a tension spring 86 and a coupling means 88 (FIG. 5). The coupling means 88 is used for coupling the housing 14-4 to the floor 82 at a slot 90 (FIG. 1) therein so as to maintain the front panel 70 of the pusher 14-3 parallel to the stop 14-2 and the linear portion 42-1 of the endless belt 42.

The coupling means 88 includes a stabilizer member 92, shown best in FIGS. 5 and 6. The stabilizer member 92 includes a curved portion 94 and a plate 96 depending therefrom. The plate 96 has a first bearing or idler roller 98 rotatably mounted thereon, and it also has a second idler roller 100 rotatably mounted on an opposite side of the plate 96 as shown best in FIG. 6. The coupling means 88 also includes a plate 102 which has a slot 104 therein to receive the roller 100, with the plate 102 being secured to the underside of the floor 82 of the hopper module 14. The slot 104 is widened in the area 104-1 to enable the roller 100 to be biased towards this area 104-1 by a spring 106 when the pusher 14-3 is pushed slightly to the right of the position shown in FIG. 5 to enable the pusher 14-3 to be detachably held in the loading station mentioned. When the pusher 14-3 is in the loading position, a new stack of documents, like 20, may be stacked in the hopper module 14. The spring 106 has one end thereof fitting into a mating recess in the plate 102, and the remaining end thereof is secured to the plate 102 by a screw 108.

The tension spring 86 (FIG. 5) has one end thereof connected to a frame member 110 of the terminal 10 and the remaining end thereof connected to the plate 102 of the stabilizer member 92. The tension spring is designed to be active in helping the roller 78 move the stack 20 of documents towards the stop 14-2 until the pusher 14-3 moves from the position shown in FIG. 5 to a position in which the pusher 14-3 is about five inches from the stop 14-2 in the embodiment described. This is important in order to have a constant pressure on the first document 20-1 in the stack 20 of documents as the first document contacts the linear portion 42-1 of the endless belt 42 to avoid nonfeeds or misfeeds.

The assembly of the pusher 14-3 (FIG. 3) is as follows. After the roller 78 is mounted in the housing 14-4 as previously described and is positioned as shown in FIG. 5, the curved portion 94 of the stabilizer member 92 is passed through the slot 90 (FIG. 1) in the floor 82. Thereafter, the front end of the curved portion 94 fits into an opening 112 in the housing 14-4 and a fastener 114 (FIG. 5) is used to secure the stabilizer member 92 to the housing 14-4. The plate 102 is then secured to the underside of the floor 82.

The curved portion 94 of the stabilizer member 92 which fits into the slot 90 (FIG. 1) is used to maintain the front panel 70 of the pusher 14-3 parallel to the linear portion 42-1 of the endless belt 42. When the pusher 14-3 is pushed from the stop 14-2 to the loading position shown approximately in FIG. 5, the roller 98 contacts the underside of the floor 82 and keeps the top of the pusher 14-3 from moving to the right (as viewed in FIG. 5) to prevent binding of the pusher 14-3 relative to the floor 82.

Another feature of the present invention is that a velocity sensing means is employed to detect the velocity of the pusher 14-3 as it moves from the loading position towards the stack 20 of documents or as it moves a stack 20 of documents towards the linear portion 42-1 of the endless belt 42. When the velocity of the pusher 14-3 exceeds a predetermined level, the pusher 14-3 applies too much pressure to the first document 20-1 in the stack 20 of documents, preventing the document from being fed. When this predetermined level is exceeded, the controller 18-1 delays the energization of the motor 46 for a predetermined time until the pressures against the first document 20-1 stabilize to acceptable levels. Thereafter, the motor 46 is energized to start feeding by the endless belt 42. In the embodiment described, the predetermined velocity is 3.69 inches per second, and the predetermined time is 0.26 second. Naturally, different applications might require different velocities and times.

To determine the velocity of the pusher 14-3 as it moves towards the stop 14-2, the velocity sensing means includes a light sensor combination, shown schematically as sensor 116, and a timing strip 118 (FIG. 7). The strip 118 has a repeated pattern of a wide bar 120 (4 mm), wide space 122 (4 mm), narrow bar 122 (2 mm), narrow space 126 (2 mm), and wide bar 120, to repeat the pattern, when reading from right to left as viewed in FIG. 8. The controller 18-1 has the necessary software for interpreting the signals from the sensor 116 (FIG. 5). A wide bar 120, followed by a wide space 122 indicates reading in one direction, while a wide space 122 followed by a wide bar 120 indicates reading in the opposite direction. One complete repetition of the pattern of the strip 118 is used to determine the velocity of the pusher 14-3 as it moves towards the stop 14-2. The strip 118 is positioned on the underside of the floor 82 and runs along the length of the plate 102 shown in FIG. 5 to coact with the sensor 116 which is mounted on the stabilizer member 92 to move with the pusher 14-3. The detection of one pattern (two bars and two spaces), starting with any bar or space, is used by the controller 18-1 to calculate the direction and speed of the pusher 14-3. The use of the sensor 116 and strip 118 enables the velocity to be detected substantially along the length of the hopper module 14.

What is claimed is:

1. A hopper module comprising:

a hopper;

a pusher;

biasing means for biasing said pusher from a loading station to a picking station in said hopper;

a document picker located at said picking station;

a velocity sensor for generating a velocity signal corresponding to the velocity of the pusher as the pusher is moved by said biasing means from said loading station towards a stack of documents in said hopper; and a controller for energizing said document picker, for receiving the velocity signal, and for delaying the energization of said document picker for a predetermined time whenever the velocity signal exceeds a predetermined level.

2. The hopper module as claimed in claim 1 in which:

said hopper has a floor which slopes downwardly towards said picking station;

said pusher has a housing; and said biasing means includes:

a roller rotatably mounted in said housing and having a mass for moving said stack of documents toward said picking station; and a resilient member which is coupled to said housing to assist said roller in moving said stack of documents as said housing is moved from said loading station to a predetermined point before reaching said picking station.

3. The hopper module as claimed in claim 2 in which:

said floor has a slot therein;

said housing also includes a planar face for contacting said stack of documents; and said biasing means includes coupling means for coupling said housing to said floor at said slot to maintain said planar face of said housing substantially parallel to said linear portion of said endless belt.

4. The hopper module as claimed in claim 3 in which said module also includes a means for detachably securing said pusher at said loading station.

5. The hopper module as claimed in claim 4 in which said floor has rails upstanding therefrom to enable said stack of documents to slide thereon and said roller to roll thereon.

6. The hopper module as claimed in claim 5 in which said roller has a large mass relative to the stack of documents and said roller has a diameter which is equal to about half the height of the documents in said stack.

7. An apparatus comprising:

a hopper module for storing a stack of documents to be fed;

said hopper module including:

a hopper having an alignment side and a stop;

a pusher;

biasing means for biasing said pusher from a loading station to a picking station located at said stop in said hopper;

a document picker located at said picking station;

a velocity sensor for generating a velocity signal corresponding to the velocity of the pusher as the pusher is moved by said biasing means from said loading station towards a stack of documents in said hopper; and a controller for energizing said document picker, for receiving the velocity signal, and for delaying the energization of said document picker for a predetermined time whenever the velocity signal exceeds a predetermined level;

said document picker comprising:

a drive roller and an idler roller having an endless belt mounted thereon to provide a linear portion of the endless belt parallel to a first document to be picked from the stack, with said linear portion engaging the first document to be picked;

a retard mechanism positioned adjacent said alignment side and in opposed relationship with said linear portion of said endless belt;

said retard mechanism having a retard member including a first portion to engage the documents in said stack and also having a second portion substantially parallel to said linear portion to permit only one document to be moved towards a document track by said linear portion of said endless belt, said first and second portions forming a wiper; and a resilient member to bias said second portion towards said linear portion of said endless belt.

8. The apparatus as claimed in claim 7 in which said endless belt is made of an elastomeric material which wears without glazing in use.

9. The apparatus as claimed in claim 8 in which said endless belt has a coefficient of friction which is greater than the coefficient of friction of said wiper of said retard mechanism.

10. The apparatus as claimed in claim 9 in which said hopper has an idler roller protruding from said stop to engage said stack of documents.

* * * * *